US012030157B2

(12) United States Patent
Suzuki

(10) Patent No.: US 12,030,157 B2
(45) Date of Patent: Jul. 9, 2024

(54) PROCESSING METHOD

(71) Applicant: DISCO CORPORATION, Tokyo (JP)

(72) Inventor: Yoshikazu Suzuki, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 345 days.

(21) Appl. No.: 17/658,036

(22) Filed: Apr. 5, 2022

(65) Prior Publication Data

US 2022/0339753 A1 Oct. 27, 2022

(30) Foreign Application Priority Data

Apr. 26, 2021 (JP) ..... 2021-074385

(51) Int. Cl.
*B24B 37/04* (2012.01)

(52) U.S. Cl.
CPC ..... *B24B 37/042* (2013.01)

(58) Field of Classification Search
CPC ..... B24B 7/228; B24B 7/04; B24B 37/04; B24B 37/042; B24B 37/047; B24B 41/06; B24B 41/068
See application file for complete search history.

(56) References Cited

U.S. PATENT DOCUMENTS 5,816,895 A * 10/1998 Honda ..... B24B 7/16 451/6
6,220,945 B1 * 4/2001 Hirokawa ..... B24B 49/16 451/287
6,656,818 B1 * 12/2003 Kishimoto ..... H01L 21/02013 438/692
6,685,542 B2 * 2/2004 Mori ..... B24B 41/047 451/287
2002/0081954 A1 * 6/2002 Mori ..... B24B 7/228 451/65
2008/0132032 A1 * 6/2008 Tomita ..... H01L 21/02024 438/455
2009/0186562 A1 * 7/2009 Kajiyama ..... B24B 37/042 451/57

(Continued)

FOREIGN PATENT DOCUMENTS

CN 109290876 A * 2/2019 ..... B24B 27/0023
DE 102020207765 A1 * 12/2020 ..... B24B 27/0076

(Continued)

*Primary Examiner* — Joel D Crandall
(74) *Attorney, Agent, or Firm* — Greer Burns & Crain Ltd.

(57) ABSTRACT

A workpiece surface is polished by a polishing pad surface by keeping a point on an outer circumferential edge of the workpiece surface at predetermined coordinates, i.e., first coordinates, in a plane parallel to the workpiece surface but out of contact with the polishing pad surface, and keeping a point on the outer circumferential edge of the polishing pad surface at other coordinates, i.e., third coordinates, in the coordinate plane in contact with an outer circumferential edge of the workpiece surface. In this manner, the workpiece surface is polished in its entirety, and a region of the polishing pad surface in the vicinity of the outer circumferential edge thereof can be worn to the same degree as a region that is located inwardly of the above region. The polishing pad surface is thus prevented from developing a stepped profile due to the polishing of the workpiece surface.

2 Claims, 9 Drawing Sheets

(56) References Cited

U.S. PATENT DOCUMENTS

| | | | | |
|---|---|---|---|---|
| 2009/0247050 | A1* | 10/2009 | Arisa | B24B 7/228 451/10 |
| 2010/0032806 | A1* | 2/2010 | Kihara | H01L 21/02532 257/618 |
| 2014/0183163 | A1* | 7/2014 | Sugiya | B24B 1/00 216/52 |
| 2015/0239093 | A1* | 8/2015 | Fukui | H01L 23/49524 451/5 |
| 2018/0099375 | A1* | 4/2018 | Ando | B24B 41/06 |
| 2018/0204746 | A1* | 7/2018 | Kuwana | H01L 21/67219 |
| 2019/0291239 | A1* | 9/2019 | Yoshida | B24B 27/0023 |
| 2020/0180105 | A1* | 6/2020 | Inoue | B24B 51/00 |
| 2020/0316750 | A1* | 10/2020 | Matsubara | B24B 5/50 |
| 2022/0080551 | A1* | 3/2022 | Fukunaga | B24B 41/06 |

FOREIGN PATENT DOCUMENTS

| | | | | | |
|---|---|---|---|---|---|
| JP | 2003243345 | A | | 8/2003 | |
| JP | 2016184604 | A | * | 10/2016 | |
| JP | 2019093517 | A | * | 6/2019 | |
| JP | 6539467 | B2 | * | 7/2019 | |
| JP | 2020093381 | A | * | 6/2020 | B24B 37/005 |
| JP | 2020196100 | A | * | 12/2020 | B23Q 1/26 |

* cited by examiner

PROCESSING METHOD

BACKGROUND OF THE INVENTION

Field of the Invention

The present invention relates to a processing method of polishing a workpiece having a circular surface to be polished using a polishing pad having a circular polishing surface.

Description of the Related Art

Chips of electronic devices such as semiconductor devices, optical devices, etc. are manufactured from workpieces such as semiconductor wafers made of silicon (Si), silicon carbide (SiC), or the like, or insulative wafers made of sapphire, i.e., aluminum oxide ($Al_2O_3$), or the like, for example. Specifically, chips are fabricated by thinning down a workpiece having a number of devices formed in respective areas on its face side and then dividing the areas on the workpiece into the chips.

One way of thinning down a workpiece is to grind a reverse side of the workpiece opposite a face side thereof where devices are formed. However, when the reverse side of the workpiece is ground, a layer, i.e., a fractured layer, where the crystalline structure of the material of the workpiece is disrupted may be formed on the reverse side, and/or grinding marks may be left, and fine cracks may be formed on the reverse side. If the workpiece is then divided into chips, the obtained chips may possibly have their flexural strength lowered.

It is customary in the art to polish the ground surface of the workpiece in order to remove a fractured layer, grinding marks, and/or cracks from the ground surface (see, for example, JP2003-243345A). Specifically, the workpiece is polished by rotating a polishing pad made of a resin such as foamed polyurethane or a non-woven fabric such as felt and abrasive grains dispersed in the resin or the non-woven fabric, for example, and the workpiece respectively about their rotational axes, while the polishing pad is having its polishing surface held in contact with the reverse side, i.e., the surface to be polished, of the workpiece.

SUMMARY OF THE INVENTION

The polishing surface of a polishing pad is worn when it polishes the surface to be polished of a workpiece. If only a partial area of the polishing surface of a polishing pad is used to polish a number of workpieces whose surfaces to be polished are of the same size, then the polishing surface of the polishing pad may develop a stepped profile. For example, an area of the polishing surface in the vicinity of its outer circumferential edge may protrude downwardly below another area of the polishing surface that lies radially inwardly.

When the polishing pad whose polishing surface has such a stepped profile is used to polish the surface to be polished of a workpiece, it may make the surface to be polished of the workpiece difficult to planarize. Specifically, since the polishing pad is generally pliable, the polishing surface of the polishing pad is liable to be deformed when it polishes the surface to be polished of the workpiece.

For example, when the polishing pad polishes the workpiece, the polishing pad may exert a larger load on the workpiece near its outer circumferential edge due to the stepped profile on the polishing surface of the polishing pad.

If the polishing pad polishes a workpiece whose surface to be polished is of the same size as the number of workpieces referred to above, an area of the workpiece in the vicinity of its outer circumferential edge tends to be excessively polished and thinned into edge roll-off.

In view of the foregoing difficulties, it is an object of the present invention to provide a processing method capable of keeping a polishing pad shaped for planarizing the surface to be polished of a workpiece, even after a polishing of the surface to be polished of workpiece, by preventing a polishing surface of the polishing pad from developing a stepped profile due to the polishing.

In accordance with an aspect of the present invention, there is provided a processing method of polishing a workpiece having a circular surface to be polished using a polishing pad having a circular polishing surface. The processing method includes a holding step of holding the workpiece on a chuck table having a conical holding surface having a protruding center, an adjusting step of adjusting an angle formed between a rotational axis of the chuck table and a rotational axis of the polishing pad in order to make a line segment interconnecting a point on an outer circumferential edge of the holding surface, whose distance to the polishing surface in a direction perpendicular thereto is the shortest, and the center of the holding surface, parallel to the polishing surface, a positioning step of moving the polishing pad and the chuck table horizontally relatively to each other to position the polishing pad above the chuck table such that first coordinates at which a point on an outer circumferential edge of the surface to be polished in alignment with the line segment is positioned do not overlap the polishing pad and second coordinates at which the center of the surface to be polished is positioned overlap the polishing pad in a coordinate plane parallel to the polishing surface, and a polishing step of polishing the workpiece by keeping the point on the outer circumferential edge of the surface to be polished at the first coordinates out of contact with the polishing surface and keeping a point on the outer circumferential edge of the surface to be polished at third coordinates on the coordinate plane that are different from the first coordinates in contact with an outer circumferential edge of the polishing surface while the polishing pad and the chuck table are being rotated about respective rotational axes thereof.

Preferably, the processing method further includes a dressing step of dressing the polishing pad before the positioning step, in which, in the dressing step, a recess is formed in a circular central region of the polishing surface, and in which a portion of a boundary of an interface where the polishing surface and the surface to be polished are held in contact with each other in the polishing step is of an arcuate shape along an outer circumferential edge of the recess.

According to the present invention, a surface to be polished of a workpiece is polished by a polishing surface of a polishing pad by keeping a point on an outer circumferential edge of the surface to be polished at predetermined coordinates, i.e., first coordinates, included in a coordinate plane parallel to the polishing surface out of contact with the polishing surface and keeping a point on the outer circumferential edge of the surface to be polished at other coordinates, i.e., third coordinates, in the coordinate plane in contact with an outer circumferential edge of the polishing surface. In this manner, the surface to be polished of the workpiece is polished in its entirety, and a region of the polishing surface of the polishing pad in the vicinity of the outer circumferential edge thereof can be worn to the same degree as a region of the polishing surface that is located inwardly of the above region.

The polishing surface of the polishing pad is thus prevented from developing a stepped profile due to the polishing of the surface to be polished of the workpiece. Even after the polishing pad has polished the workpiece, the polishing pad remains shaped for planarizing the surface to be polished of another workpiece.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
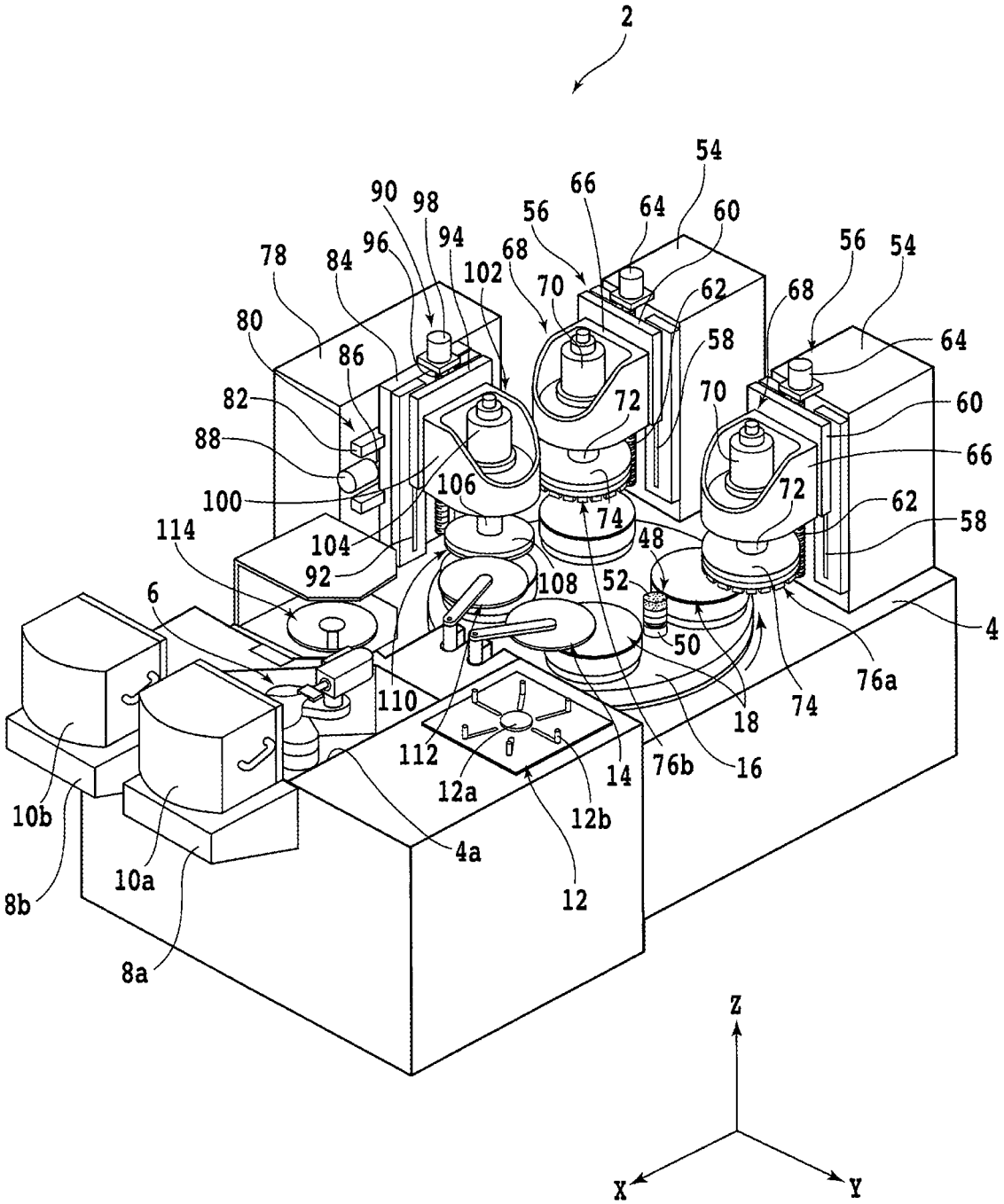
FIG. 1 is a perspective view schematically illustrating a processing apparatus by way of example.

A preferred embodiment of the present invention will be described below with reference to the accompanying drawings. FIG. 1 schematically illustrates, in perspective, a processing apparatus capable of grinding and polishing a workpiece. In FIG. 1, X-axis directions, i.e., forward and rearward directions, extend horizontally, and Y-axis directions, i.e., leftward and rightward directions, extend horizontally. The X-axis directions and the Y-axis directions extend perpendicularly to each other in a horizontal plane. Z-axis directions, i.e., upward and downward directions, extend vertically and perpendicularly to the X-axis directions and the Y-axis directions.

Figure 2:
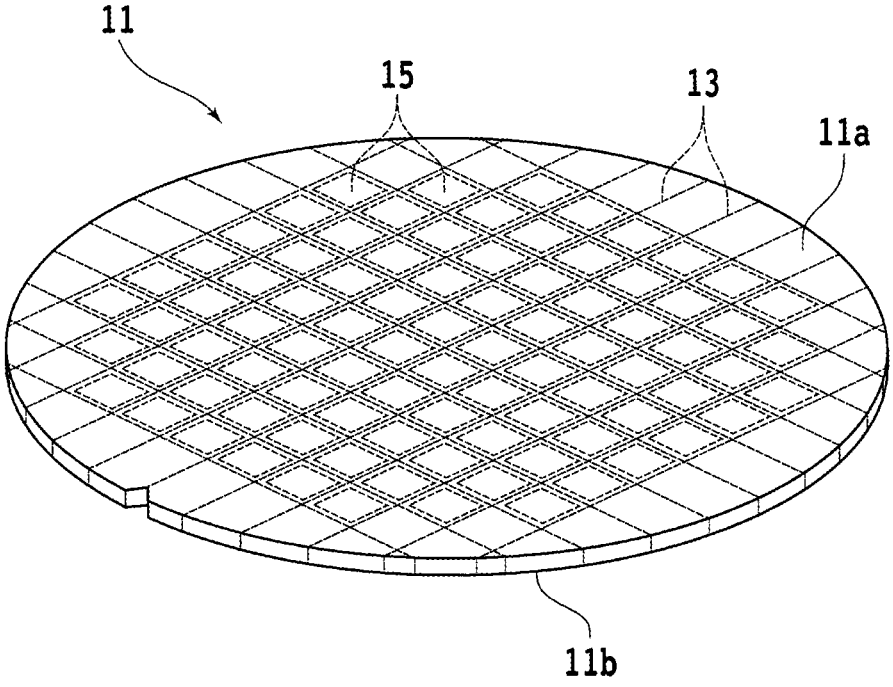
FIG. 2 is a perspective view schematically illustrating a workpiece by way of example.

The processing apparatus 2 in FIG. 1 includes a base 4 supporting various components thereon. The base 4 has an opening 4*a* defined in a front portion of an upper surface thereof and housing therein a delivery mechanism 6 for delivering plate-shaped workpieces. FIG. 2 schematically illustrates, in perspective, a workpiece 11 to be delivered by the delivery mechanism 6 by way of example.

As illustrated in FIG. 2, the workpiece 11 is a circular wafer made of a semiconductor material such as silicon (Si) and having a circular face side 11*a* and a circular reverse side 11*b*. The face side 11*a* of the workpiece 11 has a plurality of areas demarcated by a plurality of intersecting projected dicing lines 13 and having respective devices 15 such as integrated circuits (ICs) formed therein.

A film-like tape having generally the same diameter as the workpiece 11 may be affixed to the face side 11*a* of the workpiece 11. The tape is made of a resin, for example, and protects the devices 15 by reducing shocks that are applied to the face side 11*a* when the reverse side 11*b* of the workpiece 11 is ground.

The workpiece 11 is not limited to any particular materials, shapes, structures, sizes, etc. For example, the workpiece 11 may be a substrate made of any of other semiconductor materials, ceramics, resins, metals, or the like. Similarly, the devices 15 are not limited to any particular kinds, quantities, shapes, structures, sizes, layouts, etc. The workpiece 11 may be free of devices 15.

As illustrated in FIG. 1, the processing apparatus 2 includes a pair of cassette tables 8*a* and 8*b* attached to a front end of the base 4 in front of the opening 4*a*. The cassette tables 8*a* and 8*b* support thereon respective cassettes 10*a* and 10*b* that can house a plurality of workpieces 11. A position adjusting mechanism 12 for adjusting the position of a workpiece 11 is disposed on the base 4 obliquely behind the opening 4*a*.

The position adjusting mechanism 12 includes, for example, a table 12*a* for supporting a central portion of a workpiece 11 and a plurality of pins 12*b* positioned around the table 12*a* at angularly spaced intervals and radially movable toward and away from the table 12*a*. When a workpiece 11 unloaded from the cassette 10*a* by the delivery mechanism 6 is placed on the table 12*a*, for example, the pins 12*b* are radially moved into contact with an outer circumferential edge of the workpiece 11, centering the workpiece 11 on the table 12*a*, i.e., aligning the center of the workpiece 11 with the center of the table 12*a*.

A loading mechanism 14 that can be turned while holding a workpiece 11 is disposed in the vicinity of the position adjusting mechanism 12. The loading mechanism 14 includes a suction pad for attracting an upper surface of a workpiece 11 under suction. The loading mechanism 14 delivers a workpiece 11 that has been positionally adjusted by the position adjusting mechanism 12 from the position adjusting mechanism 12 rearwardly to a position over a disk-shaped turntable 16 that is mounted on the base 4 behind the loading mechanism 14.

The turntable 16 is coupled to a rotary actuator, not illustrated, such as an electric motor, and rotatable about a rotational axis extending straight parallel to the Z-axis directions. The turntable 16 has four chuck tables 18 mounted on its upper surface for supporting thereon respective workpieces 11 while the workpieces 11 are being processed. The chuck tables 18 are positioned at generally equal angular intervals along circumferential directions of the turntable 16. The number, etc. of the chuck tables 18 mounted on the turntable 16 is not limited.

The loading mechanism 14 attracts a workpiece 11 on the position adjusting mechanism 12 under suction with the suction pad, lifts the workpiece 11 off the position adjusting mechanism 12, and loads the workpiece 11 onto one of the chuck tables 18 that is disposed in a loading/unloading position near the loading mechanism 14. The turntable 16 is rotated about its central axis in the direction indicated by the arrow in FIG. 1, for example, to move each of the chuck tables 18 successively through the loading/unloading position, a rough grinding position, a finish grinding position, and a polishing position.

Figure 3:
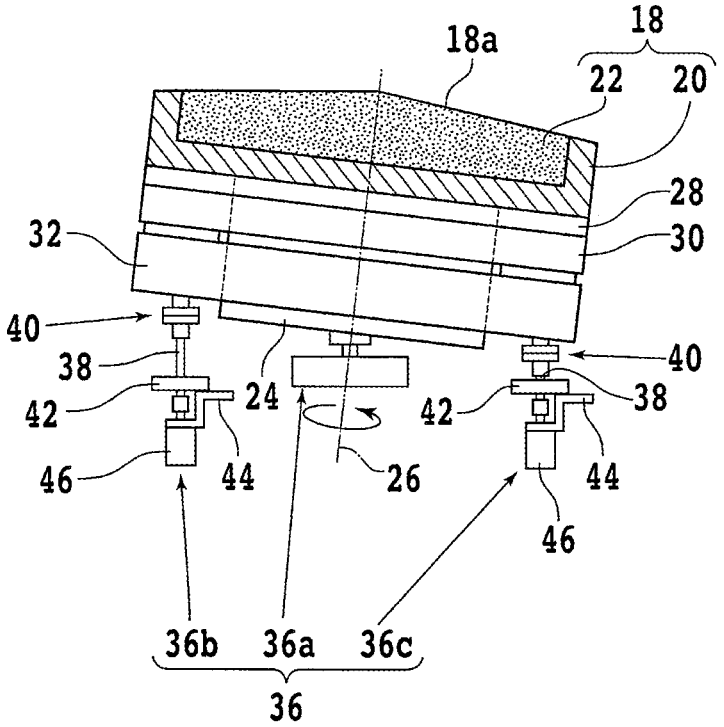
FIG. 3 is a side elevational view, partly in cross section, schematically illustrating a chuck table of the processing apparatus by way of example.

FIG. 3 schematically illustrates one of the chuck tables 18 in side elevation partly in cross section. Since the chuck tables 18 are structurally identical to each other, only one of them will be described in detail below. The chuck table 18 has a frame 20 made of a metal material such as stainless steel or ceramic. The frame 20 has a disk-shaped bottom wall and an annular side wall extending upwardly from an outer circumferential portion of the bottom wall. The bottom wall and the side wall jointly define an upwardly open cavity in the frame 20.

The bottom wall of the frame 20 has a suction channel, not illustrated, defined therein. The suction channel has an end exposed at the bottom surface of the cavity and another end connected to a suction source, not illustrated, such as an ejector. The chuck table 18 also has a porous plate 22 fixedly disposed in the cavity. The porous plate 22 has a generally flat lower surface and an upwardly protruding conical upper surface whose center is located at its vertex.

When the suction source is actuated, it generates and transmits a negative pressure through the suction channel to a space in the vicinity of the upper surface of the porous plate 22. Therefore, the upper surface of the porous plate 22 functions as a holding surface 18*a* of the chuck table 18 for holding a workpiece 11 under suction thereon. Specifically, when the suction source is actuated with a workpiece 11 on the upper surface of the porous plate 22, i.e., the holding surface 18*a* of the chuck table 18, the workpiece 11 is held under suction on the chuck table 18.

A cylindrical spindle 24 has an upper portion coupled to a lower portion of the chuck table 18. The chuck table 18 is detachably coupled to the spindle 24. The spindle 24 has a lower portion coupled to a rotary actuator, not illustrated, such as an electric motor. When the rotary actuator is energized, it rotates the spindle 24 about its central axis, rotating the chuck table 18 about a rotational axis 26 that extends through the center of the holding surface 18*a*.

The chuck table 18 is rotatably supported by an annular bearing 28 disposed beneath the chuck table 18. The bearing 28 is fixed to an annular support plate 30 disposed beneath the bearing 28. The support plate 30 is mounted on an annular table base 32 disposed therebelow. The spindle 24 is disposed in openings defined centrally in the bearing 28, the support plate 30, and the table base 32, respectively.

The table base 32 has a lower surface disposed on three support mechanisms, i.e., a fixed support mechanism 36*a*, a first movable support mechanism 36*b*, and a second movable support mechanism 36*c*, that are disposed at generally equal angular intervals along circumferential directions of the table base 32. The three support mechanisms 36*a*, 36*b*, and 36*c* will also collectively be referred to as a tilt adjusting unit 36 hereinbelow.

The table base 32 is supported on the fixed support mechanism 36*a*, the first movable support mechanism 36*b*, and the second movable support mechanism 36*c*. The fixed support mechanism 36*a* has a support post, i.e., a fixed shaft, having a predetermined length. The support post has an upper portion coupled to an upper support body fixed to the lower surface of the table base 32 and a lower portion fixed to a support base.

Each of the first movable support mechanism 36*b* and the second movable support mechanism 36*c* has a support post, i.e., a movable shaft, 38 having an externally threaded upper distal end portion. The externally threaded upper distal end portion of the support post 38 is rotatably coupled to an upper support body 40 fixed to the lower surface of the table base 32. Specifically, the upper support body 40 is an internally threaded columnar member of metal such as an internally threaded rod. The externally threaded upper distal end portion of the support post 38 is operatively threaded in the internally threaded columnar member of the upper support body 40.

An annular bearing 42 having a predetermined outside diameter is fixedly mounted on an outer circumferential surface of the support post 38 of each of the first movable support mechanism 36*b* and the second movable support mechanism 36*c*. The bearing 42 has a portion supported on a stepped support plate 44. In other words, the first movable support mechanism 36*b* and the second movable support mechanism 36*c* are supported on respective stepped support plates 44.

Each of the support posts 38 has a lower portion coupled to an electric motor 46 that rotates the support post 38 about its central axis. When the electric motor 46 is energized, it rotates the support post 38 in one direction, lifting the upper support body 40. When the electric motor 46 is reversed, it rotates the support post 38 in the other direction, lowering the upper support body 40. The upper support bodies 40 of the first movable support mechanism 36*b* and the second movable support mechanism 36*c* are selectively lifted or lowered, the tilt adjusting unit 36 adjusts the tilt of the table base 32, i.e., the chuck table 18.

Other components of the processing apparatus 2 will be described below with reference to FIG. 1. A dressing unit 48 for dressing a polishing pad 110 to be described later is disposed on the turntable 16 at a position between adjacent two of the chuck tables 18 arrayed along the circumferential directions of the turntable 16. The dressing unit 48 has a cylindrical support member 50 having a lower end fixed to the upper surface of the turntable 16. The support member 50 has an upper end on which there is mounted a dressing tool 52.

The dressing tool 52 has a structure in which abrasive grains are dispersed in a bonding material such as a resin or a structure in which a plated layer with abrasive grains dispersed therein is disposed on the surface of the upper end of the support member 50. The abrasive grains are made of silicon carbide (SiC), cubic boron nitride (cBN), or diamond, or include fine particles of metal oxide, or the like. The fine particles of metal oxide may be fine particles of silica, i.e., silicon oxide, ceria, i.e., cerium oxide, zirconia, i.e., zirconium oxide, alumina, i.e., aluminum oxide, or the like.

A pair of columnar support structures 54 are mounted on the base 4 respectively behind the rough grinding position and the finish grinding position, i.e., behind the turntable 16. Z-axis moving mechanisms 56 are disposed on respective front surfaces of the support structures 54 that face the turntable 16. The Z-axis moving mechanisms 56 have respective pairs of guide rails 58 fixed to the front surfaces of the support structures 54 and extending along the Z-axis directions.

A pair of movable plates 60 are slidably mounted on the respective pairs of guide rails 58 for sliding movement along the guide rails 58. Screw shafts 62 extending along the Z-axis directions are disposed between the guide rails 58 of the respective pairs. Electric motors 64 for rotating the screw shafts 62 about their central axes are coupled to respective upper ends of the screw shafts 62.

Nuts, not illustrated, that house therein balls, not illustrated, rolling in helical grooves defined in the screw shafts 62 upon rotation thereof are mounted on the screw shafts 62. The screw shafts 62, the nuts, and the balls jointly make up ball screws. When the screw shafts 62 are rotated about their central axes by the electric motors 64, the balls are circulated in the nuts, causing the nuts to move along one of the Z-axis directions.

The nuts are fixed to rear surfaces, i.e., reverse side surfaces, of the movable plates 60 that face the support structures 54. Therefore, when the screw shafts 62 are rotated by the electric motors 64, the nuts and hence the movable plates 60 are caused to move along one of the Z-axis directions. Fixtures 66 are mounted on respective front surfaces, i.e., face side surfaces, of the movable plates 60 that face the turntable 16.

The fixtures 66 support respective grinding units 68 for grinding respective workpieces 11. The grinding units 68 have respective spindle housings 70 that are secured to the fixtures 66. Spindles 72 extending along the Z-axis directions are rotatably housed in the spindle housings 70, respectively.

The spindles 72 have respective upper ends coupled to respective rotary actuators, not illustrated, such as electric motors. The spindles 72 are rotatable about their central axes by the rotary actuators. The spindles 72 have respective lower ends exposed from respective lower surfaces of the spindle housings 70 and coupled to respective disk-shaped mounts 74.

A grinding wheel 76*a* for rough grinding is mounted on a lower surface of the mount 74 of the grinding unit 68 in the rough grinding position. The grinding wheel 76*a* for rough grinding includes a wheel base that is generally equal in diameter to the mount 74. The wheel base is made of a metal material such as stainless steel or aluminum, for example.

A plurality of grindstones each including abrasive grains suitable for rough grinding are fixed to a lower surface of the wheel base. Each of the grindstones has a lower surface, i.e., a grinding surface, lying generally perpendicular to the Z-axis directions. The grindstones on the grinding wheel 76*a* for rough grinding performs rough grinding a workpiece 11 held under suction on the chuck table 18 disposed in the rough grinding position.

Similarly, a grinding wheel 76*b* for finish grinding is mounted on a lower surface of the mount 74 of the grinding unit 68 in the finish grinding position. The grinding wheel 76*b* for finish grinding includes a wheel base that is generally equal in diameter to the mount 74. The wheel base is made of a metal material such as stainless steel or aluminum, for example.

A plurality of grindstones each including abrasive grains suitable for finish grinding are fixed to a lower surface of the wheel base. Each of the grindstones has a lower surface, i.e., a grinding surface, lying generally perpendicular to the Z-axis directions. The grindstones on the grinding wheel 76*b* for finish grinding performs finish grinding a workpiece 11 held under suction on the chuck table 18 disposed in the finish grinding position. The diameters of the abrasive grains included in the grindstones for finish grinding are generally smaller than the diameters of the abrasive grains included in the grindstones for rough grinding.

Fluid supply nozzles, not illustrated, for supplying a fluid, i.e., a grinding fluid, such as pure water, to regions where the workpieces 11 contact the grindstones, i.e., processing points, are disposed in the vicinity of the respective grinding wheels 76*a* and 76*b*. Instead of or in addition to the fluid supply nozzles, openings for supplying a grinding fluid may be defined in the respective grinding wheels 76*a* and 76*b*, and the grinding fluid may be supplied through the openings to the processing points.

A support structure 78 is mounted on the base 4 laterally of the polishing position, i.e., laterally of the turntable 16. An X-axis moving mechanism 80 is disposed on a side surface of the support structure 78 that faces the turntable 16. The X-axis moving mechanism 80 has a pair of guide rails 82 fixed to the side surface of the support structure 78 that faces the turntable 16 and extending along the X-axis directions.

A movable plate 84 is slidably mounted on the pair of guide rails 82 for sliding movement along the guide rails 82. A screw shaft 86 extending along the X-axis directions is disposed between the guide rails 82. An electric motor 88 for rotating the screw shaft 86 about its central axis is coupled to a front end of the screw shaft 86.

A nut, not illustrated, that houses therein balls, not illustrated, rolling in helical grooves defined in the surface of the screw shaft 86 upon rotation thereof is mounted on the screw shaft 86. The screw shaft 86, the nut, and the balls jointly make up a ball screw. When the screw shaft 86 is rotated about its central axis by the electric motor 88, the balls are circulated in the nut, causing the nut to move along one of the X-axis directions.

The nut is fixed to a surface, i.e., a reverse side surface, of the movable plate 84 that faces the support structure 78. Therefore, when the screw shaft 86 is rotated by the electric motor 88, the nut and hence the movable plate 84 are caused to move along one of the X-axis directions. A Z-axis moving mechanism 90 is mounted on a surface, i.e., a face side surface, of the movable plate 84 that faces the turntable 16.

The Z-axis moving mechanism 90 has a pair of guide rails 92 fixed to the face side surface of the movable plate 84 and extending along the Z-axis directions. A movable plate 94 is slidably mounted on the pair of guide rails 92 for sliding movement along the guide rails 92.

A screw shaft 96 extending along the Z-axis directions is disposed between the guide rails 92. An electric motor 98 for rotating the screw shaft 96 about its central axis is coupled to an upper end of the screw shaft 96. A nut, not illustrated, that houses therein balls, not illustrated, rolling in helical grooves defined in the surface of the screw shaft 96 upon rotation thereof is mounted on the screw shaft 96. The screw shaft 96, the nut, and the balls jointly make up a ball screw.

When the screw shaft 96 is rotated about its central axis by the electric motor 98, the balls are circulated in the nut, causing the nut to move along one of the Z-axis directions. The nut is fixed to a rear surface, i.e., a reverse side surface, of the movable plate 94 that faces the movable plate 84. Therefore, when the screw shaft 96 is rotated by the electric motor 98, the nut and hence the movable plate 94 are caused to move along one of the Z-axis directions.

A fixture 100 is mounted on a surface, i.e., a face side surface, of the movable plate 94 that faces the turntable 16. The fixture 100 supports a polishing unit 102 for polishing a workpiece 11. The polishing unit 102 has a spindle housing 104 that is secured to the fixture 100.

A spindle 106 extending along the Z-axis directions is rotatably housed in the spindle housing 104. The spindle 106 has an upper end coupled to a rotary actuator, not illustrated, such as an electric motor. The spindle 106 is rotatable about its central axis by the rotary actuator.

The spindle 106 has a lower end exposed from a lower surface of the spindle housing 104 and coupled to a disk-shaped mount 108. A disk-shaped polishing pad 110 is mounted on a lower surface of the mount 108. The polishing pad 110 is a fixed-abrasive-grain polishing pad that is larger in diameter than a workpiece 11 to be held under suction on the chuck table 18 in the polishing position and includes abrasive grains dispersed therein.

The polishing pad 110 has a circular lower surface, i.e., a polishing surface, lying in a plane generally perpendicularly to the Z-axis directions. The polishing pad 110 polishes a workpiece 11 held under suction on the chuck table 18 in the polishing position in a dry environment. The polishing pad 110 is fabricated by, for example, impregnating a non-woven fabric of polyester with an urethane solution in which abrasive grains having an average diameter of 20 μm or less are dispersed and then drying the non-woven fabric.

The abrasive grains dispersed in the polishing pad 110 are made of SiC, cBN, diamond, or the like, or are fine particles of metal oxide or the like. The fine particles of metal oxide may be fine particles of silica, ceria, zirconia, alumina, or the like. The polishing pad 110 is pliable and slightly flexes under a load applied thereto when it polishes the workpiece 11.

An unloading mechanism 112 for unloading a workpiece 11 that has been polished by the polishing unit 102 is disposed laterally of the loading mechanism 14. The unloading mechanism 112 can be turned while holding the polished workpiece 11. A cleaning mechanism 114 for cleaning a workpiece 11 that has been unloaded by the unloading mechanism 112 is disposed in front of the unloading mechanism 112 and behind the opening 4*a*. The workpiece 11 that has been cleaned by the cleaning mechanism 114 is delivered by the delivery mechanism 6 and put into the cassette 10*b*, for example.

Figure 4:
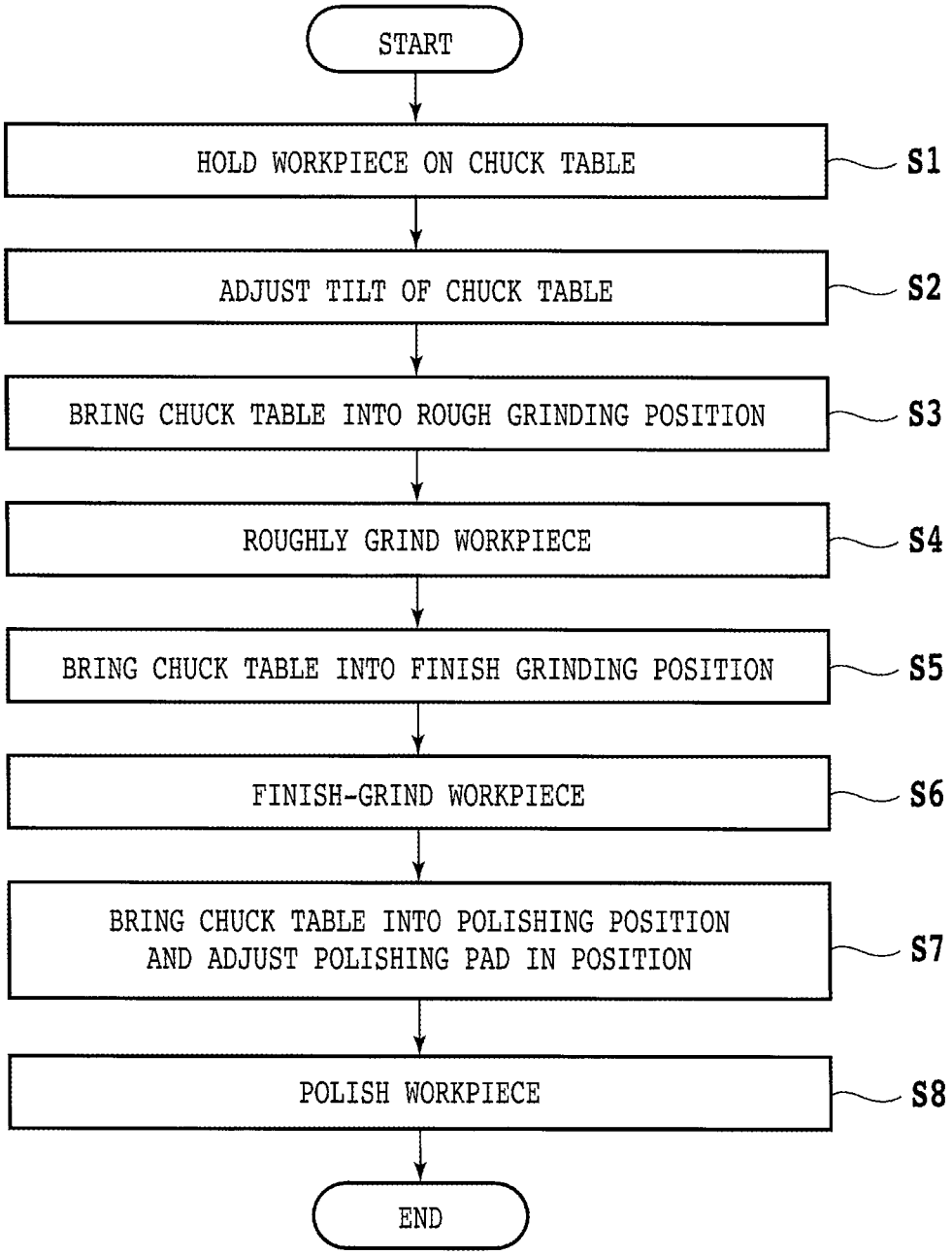
FIG. 4 is a flowchart schematically illustrating a processing method for processing the workpiece by way of example.

FIG. 4 is a flowchart schematically illustrating a processing method for processing a workpiece 11 on the processing apparatus 2 by way of example. According to the processing method, a workpiece 11 is held on the chuck table 18 (holding step: S1). Specifically, a workpiece 11 that has been adjusted to a predetermined position by the position adjusting mechanism 12 is delivered from the position adjusting mechanism 12 to the chuck table 18 in the loading/unloading position by the loading mechanism 14, after which the workpiece 11 is held under suction on the chuck table 18.

Then, the tilt of the chuck table 18 in the loading/unloading position is adjusted (tilt adjusting step: S2). Specifically, the tilt adjusting unit 36 adjusts the tilt of the chuck table 18 in order to make a line segment interconnecting a highest point on the outer circumferential edge of the holding surface 18*a* of the chuck table 18 and the center of the holding surface 18*a* perpendicular to the Z-axis directions. In other words, the tilt adjusting unit 36 adjusts the tilt of the chuck table 18 in order to make the line segment parallel to the lower surfaces, i.e., grinding surfaces, of the grindstones for rough grinding, the lower surfaces, i.e., grinding surfaces, of the grindstones for finish grinding, and the lower surface, i.e., the polishing surface, of the polishing pad 110.

Then, the chuck table 18 is brought into the rough grinding position (first positioning step: S3). Specifically, the turntable 16 is rotated about its central axis in the direction indicated by the arrow in FIG. 1 such that the path followed by the grindstones of the grinding wheel 76*a* for rough grinding upon rotation of the grinding wheel 76*a* overlaps one and other ends of the line segment referred to above, as viewed in plan.

Then, the workpiece 11 is roughly ground (roughly grinding step: S4). Specifically, while the chuck table 18 and the grinding wheel 76*a* for rough grinding are being rotated about their respective rotational axes, the grinding wheel 76*a* is lowered to bring the grinding surfaces of the grindstones into contact with an upper surface, e.g., the reverse side 11*b*, of the workpiece 11. The region where the workpiece 11 contacts the grindstones, i.e., the processing point, is supplied with the grinding fluid from the fluid supply nozzle or the like.

Then, the chuck table 18 is brought from the rough grinding position into the finish grinding position (second positioning step: S5). Specifically, the turntable 16 is rotated about its central axis in the direction indicated by the arrow in FIG. 1 such that the path followed by the grindstones of the grinding wheel 76*b* for finish grinding upon rotation of the grinding wheel 76*b* overlaps one and other ends of the line segment referred to above, as viewed in plan.

Then, the workpiece 11 is finish-ground (finish grinding step: S6). Specifically, while the chuck table 18 and the grinding wheel 76*b* for finish grinding are being rotated about their respective rotational axes, the grinding wheel 76*b* is lowered to bring the grinding surfaces of the grindstones into contact with an upper surface, e.g., the reverse side 11*b*, of the workpiece 11. The region where the workpiece 11 contacts the grindstones, i.e., the processing point, is supplied with the grinding fluid from the fluid supply nozzle or the like.

Figure 5A:
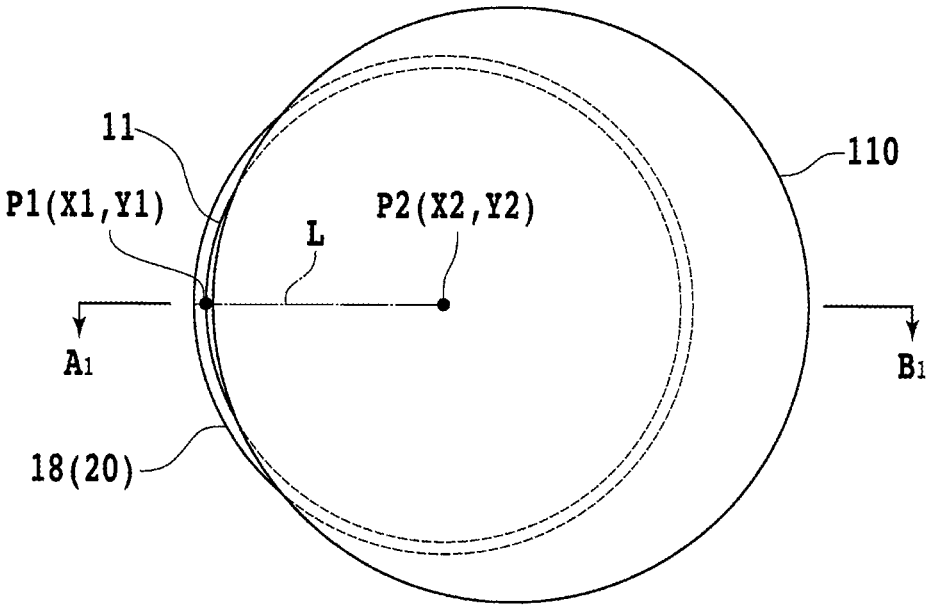
FIG. 5A is a top plan view schematically illustrating the chuck table positioned in a polishing position and a polishing pad adjusted in position.
Figure 5B:
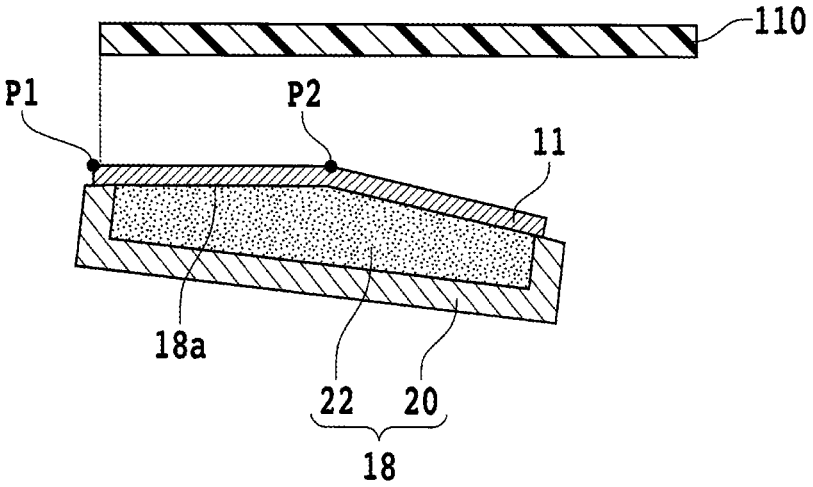
FIG. 5B is a cross-sectional view taken along line $A_1$-$B_1$ of FIG. 5A.

Then, the chuck table 18 is brought from the finish grinding position to the polishing position, and the polishing pad 110 is adjusted in position (third positioning step: S7). FIG. 5A schematically illustrates, in plan, the chuck table 18 positioned in the polishing position and the polishing pad 110 adjusted in position. FIG. 5B schematically illustrates the chuck table 18 and the polishing pad 110 in cross section taken along line $A_1$-$B_1$ of FIG. 5A.

FIG. 5A also illustrates a coordinate plane parallel to the polishing surface of the polishing pad 110, i.e., a coordinate plane parallel to the X-axis directions and the Y-axis directions, which may be termed "XY coordinate plane." In the third positioning step S7, a point P1 located on the outer circumferential edge of the upper surface, i.e., the reverse side 11*b* as a surface to be polished, of the workpiece 11 in alignment with a line segment L that represents the line segment referred to above is positioned at first coordinates (X1, Y1), and the center, denoted by P2, of the surface to be polished of the workpiece 11 that is also aligned with the line segment L is positioned at second coordinates (X2, Y2).

The point P1, i.e., the first coordinates (X1, Y1), is positioned slightly outwardly of the outer circumferential edge of the polishing pad 110, and does not overlap the polishing pad 110. The point P2, i.e., the second coordinates (X2, Y2), overlaps the polishing pad 110. In the third positioning step S7, therefore, the turntable 16 is rotated in the direction indicated by the arrow in FIG. 1 and the position of the polishing unit 102 along the X-axis directions is adjusted such that most of the surface to be polished of the workpiece 11 except an extremely small region thereof including the point P1 overlaps the polishing pad 110.

Figure 6A:
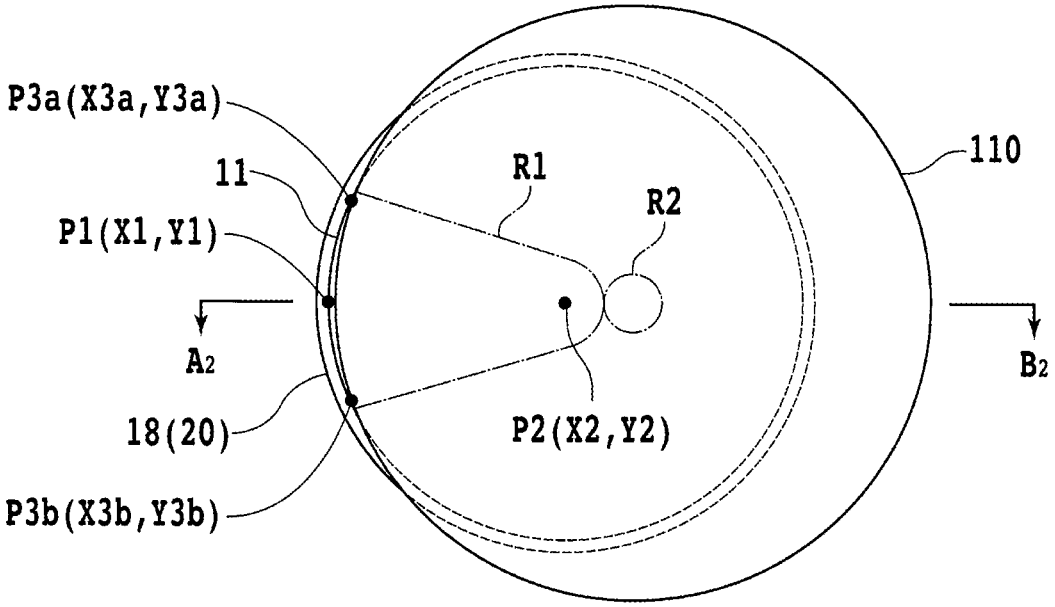
FIG. 6A is a top plan view schematically illustrating the manner in which the polishing pad polishes the workpiece.
Figure 6B:
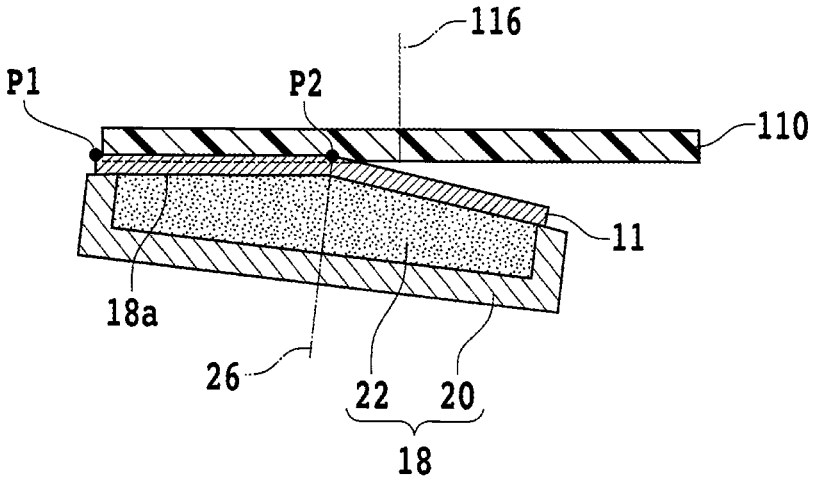
FIG. 6B is a cross-sectional view taken along line $A_2$-$B_2$ of FIG. 6A.

Then, the workpiece 11 is polished (polishing step: S8). FIG. 6A schematically illustrates, in plan, the manner in which the polishing pad 110 polishes the workpiece 11. FIG. 6B schematically illustrates the chuck table 18 and the polishing pad 110 in cross section taken along line $A_2$-$B_2$ of FIG. 6A. FIG. 6A also illustrates an XY coordinate plane.

In the polishing step S8, while the chuck table 18 is being rotated about the rotational axis 26 and the polishing pad 110 is being rotated about a rotational axis 116, the polishing pad 110 is lowered to bring the lower surface, i.e., the polishing surface, of the polishing pad 110 into contact with the surface to be polished of the workpiece 11. At this time, the polishing pad 110 slightly flexes under a load applied thereto when it polishes the workpiece 11.

Stated otherwise, a portion of the workpiece 11 bites into the polishing pad 110 (see FIG. 6B). Therefore, not only a region of the workpiece 11 that is positioned highest in the Z-axis directions, i.e., a region overlapping the line segment L illustrated in FIG. 5A, but also a region, i.e., a polished region, R1 of the workpiece 11 that is positioned slightly beneath the above region are held in contact with the polishing pad 110.

Though the polished region R1 does not include the point P1 positioned at the first coordinates (X1, Y1), the region R1 includes points P3*a* and P3*b* on the outer circumferential edge of the surface to be polished of the workpiece 11 that are positioned at third respective coordinates (X3a, Y3a), (X3b, Y3b) that are different from the first coordinates on the XY coordinate plane.

The polished region R1 varies depending on the relative positions of the chuck table 18 and the polishing pad 110 adjusted in the third positioning step S7. In the third positioning step S7, the relative positions of the chuck table 18 and the polishing pad 110 are adjusted such that the polished region R1 does not include the point P1, but includes the points P3*a* and P3*b*.

According to the processing method illustrated in FIG. 4, when the workpiece 11 is polished, the point positioned on the outer circumferential edge of the surface to be polished of the workpiece 11 at the first coordinates (X1, Y1) included in the XY coordinate plane is not held in contact with the polishing surface of the polishing pad 110, and the points positioned on the outer circumferential edge of the surface to be polished of the workpiece 11 at the third coordinates (X3a, Y3a) and (X3b, Y3b) included in the XY coordinate plane are held in contact with the outer circumferential edge of the polishing surface of the polishing pad 110. In this manner, the surface to be polished of the workpiece 11 can be polished in its entirety, and a region of the polishing surface of the polishing pad 110 in the vicinity of the outer circumferential edge thereof can be worn to the same degree as a region of the polishing surface that is located inwardly of the above region.

Consequently, the polishing surface of the polishing pad 110 is prevented from developing a stepped profile due to the polishing of the surface to be polished of the workpiece 11. Even after the polishing pad 110 has polished the workpiece 11, the polishing pad 110 remains shaped for planarizing the surface to be polished of another workpiece 11.

According to the processing method, furthermore, when the surface to be ground of the workpiece 11 is ground, a portion, i.e., an unused region, R2 (see FIG. 6A) in the vicinity of the center of the polishing surface of the polishing pad 110 may not be held in contact with the surface to be polished of the workpiece 11. If the unused region R2 remained unremoved, it would tend to protrude downwardly from an outer region therearound, i.e., to develop a stepped profile, on the polishing surface of the polishing pad 110 when the polishing pad 110 polishes the surface to be polished of the workpiece 11.

If the polishing pad 110 with the protruding unused region R2 is used to polish the surface to be polished of the workpiece 11, it would possibly be difficult to planarize the surface to be polished of the workpiece 11. Specifically, the protruding unused region R2 of the polishing pad 110 would tend to form a circular recess in the surface to be polished of the workpiece 11 in concentric relation thereto.

Figure 7:
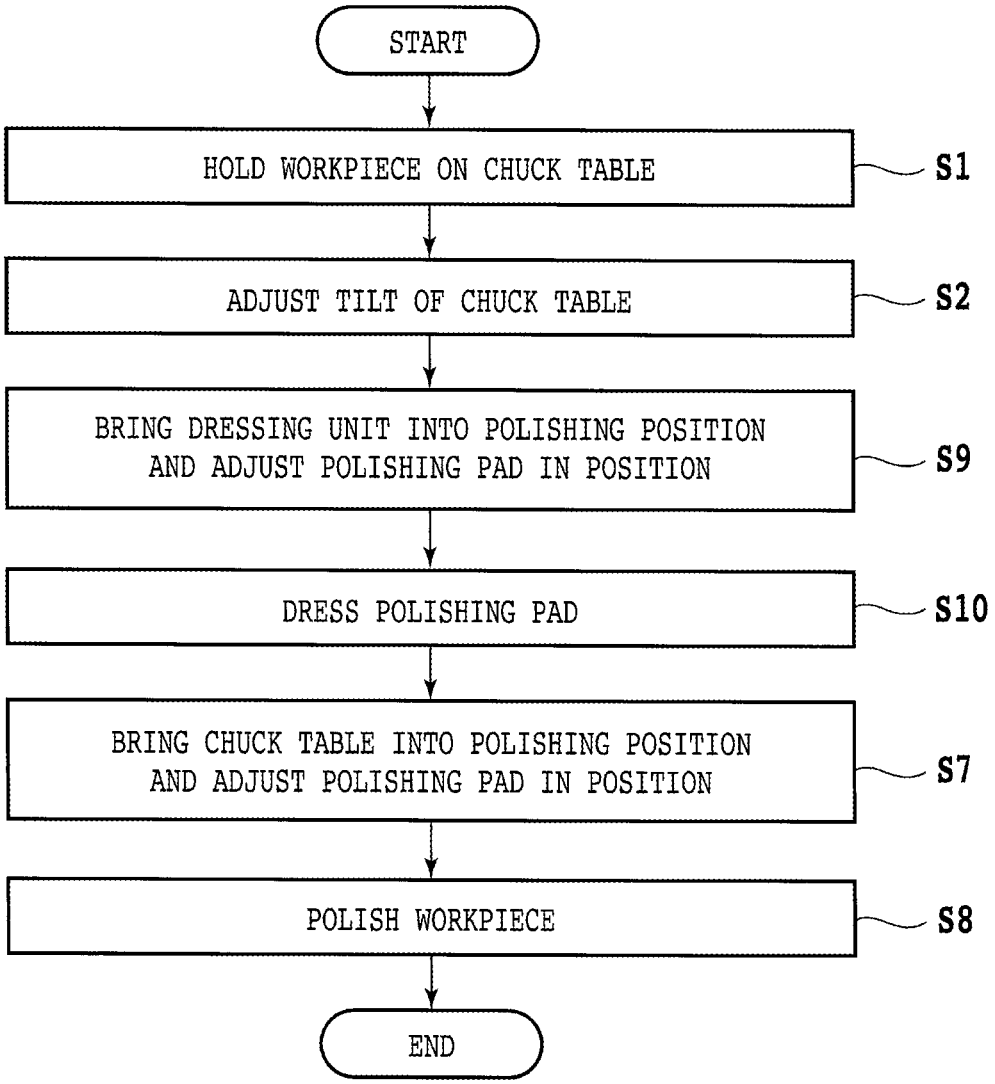
FIG. 7 is a flowchart schematically illustrating a processing method for processing a workpiece according to a modification.

According to the present embodiment, it is therefore preferable to form a recess in a circular central region of the polishing surface of the polishing pad 110 that includes the unused region R2 prior to the third positioning step S7. FIG. 7 is a flowchart schematically illustrating a processing method for processing a workpiece to form such a recess in the polishing surface of the polishing pad 110 according to a modification. The processing method illustrated in FIG. 7 begins with the holding step S1 and the tilt adjusting step S2.

Figure 8:
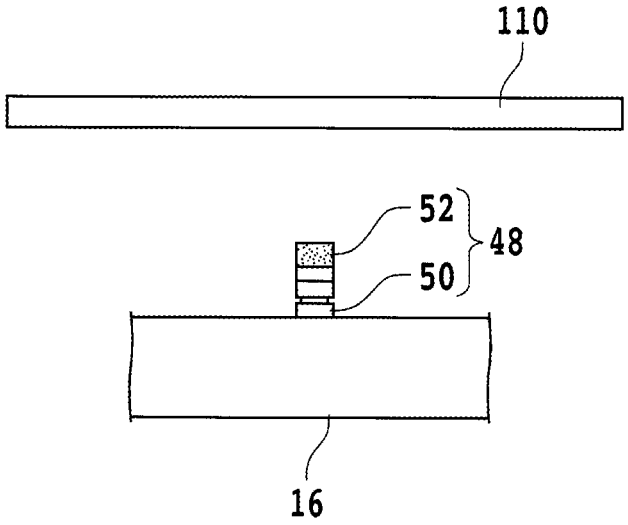
FIG. 8 is a side elevational view schematically illustrating a dressing unit positioned in a polishing position and a polishing pad adjusted in position.

Then, the dressing unit 48 is brought into a polishing position, and the polishing pad 110 is adjusted in position (fourth positioning step: S9). FIG. 8 schematically illustrates, in side elevation, the dressing unit 48 in the polishing position and the polishing pad 110 adjusted in position.

Specifically, the turntable 16 is rotated about its central axis in the direction indicated by the arrow in FIG. 1 and the position of the polishing unit 102 is adjusted along the X-axis directions such that the dressing unit 48 overlaps a central region, i.e., a region including the unused region R2 illustrated in FIG. 6A, of the polishing surface of the polishing pad 110, as viewed in plan.

Then, the dressing unit 48 dresses the polishing pad 110 (dressing step: S10). Specifically, while the polishing pad 110 is being rotated about the rotational axis 116, the polishing pad 110 is lowered to bring its lower surface, i.e., the polishing surface, into contact with an upper surface of the dressing tool 52 of the dressing unit 48. The dressing tool 52 now forms a recess in the polishing surface of the polishing pad 110. Furthermore, if necessary to form a recess in the central region of the polishing surface of the polishing pad 110, the polishing unit 102 may be moved along the X-axis directions while the polishing pad 110 is being rotated about the rotational axis 116.

Figure 9A:
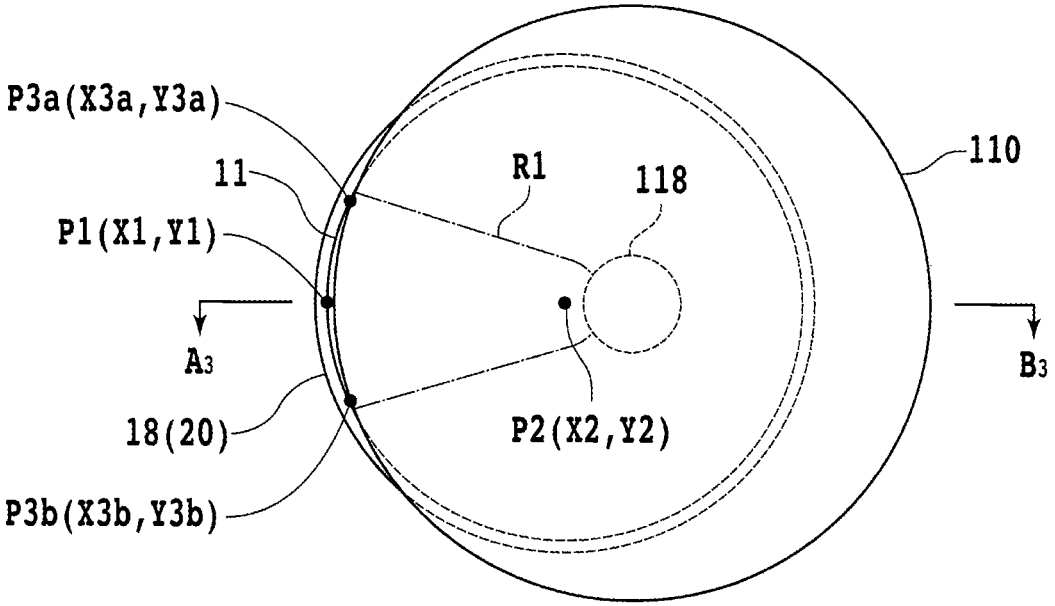
FIG. 9A is a top plan view schematically illustrating the manner in which a polishing pad that has been dressed polishes a workpiece.
Figure 9B:
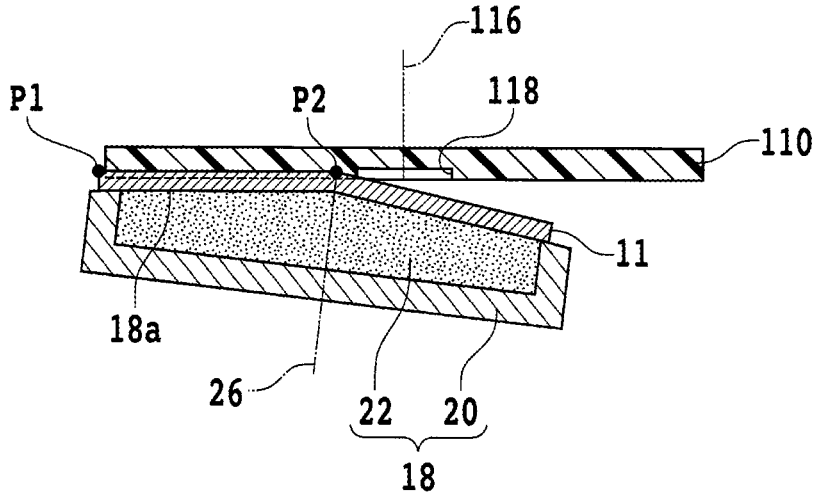
FIG. 9B is a cross-sectional view taken along line $A_3$-$B_3$ of FIG. 9A.

Then, the third positioning step S7 and the polishing step S8 are carried out. FIG. 9A schematically illustrates, in plan, the manner in which the polishing pad 110 that has been dressed polishes a workpiece 11. FIG. 9B schematically illustrates the chuck table 18 and the polishing pad 110, in cross section, taken along line $A_3$-$B_3$ of FIG. 9A. FIG. 9A also illustrates an XY coordinate plane.

As illustrated in FIGS. 9A and 9B, the polishing surface of the polishing pad 110 has a circular recess 118 formed in a circular central region thereof in the dressing step S10. The recess 118 defines a portion of the boundary of an interface represented by the polished region R1 where the polishing surface of the polishing pad 110 and the surface to be polished of the workpiece 11 are held in contact with each other. The portion of the boundary of the interface is of an arcuate shape along an outer circumferential edge of the recess 118.

Because the recess 118 is defined in the central region of the polishing surface of the polishing pad 110, the central region of the polishing surface of the polishing pad 110 is prevented from protruding downwardly from an outer region therearound, i.e., from developing a stepped profile, after the polishing step S8. Consequently, the polishing pad 110 is able to polish the entire surface to be polished of the workpiece 11 without forming a circular recess in the surface to be polished of the workpiece 11 in concentric relation thereto.

The processing methods according to the above embodiment and modification are illustrated by way of example only, and the present invention is not limited to the illustrated details. For example, the principles of the present invention are also applicable to a processing method including some of the steps of the processing method illustrated in FIG. 4 that include the holding step S1, the tilt adjusting step S2, the third positioning step S7, and the polishing step S8, but exclude the steps involving roughly grinding and finish-grinding the workpiece 11, i.e., the first positioning step S3, the roughly grinding step S4, the second positioning step S5, and the finish grinding step S6.

According to the present invention, the chuck tables 18 and the polishing unit 102 are not limited to any particular directions along which to move. For example, the chuck tables 18 may be movable along the Z-axis directions, and the polishing unit 102 may be movable along the Y-axis directions. The chuck tables 18 may not be provided on the upper surface of the turntable 16, but may be coupled to an X-axis moving mechanism and/or a Y-axis moving mechanism including a ball screw etc.

According to the present invention, moreover, the processing apparatus 2 may include a tilt adjusting unit for adjusting the tilt of the polishing unit 102. In the tilt adjusting step S2, the tilt of the chuck table 18 may not be adjusted, but the tilt of the polishing unit 102 may be adjusted by the tilt adjusting unit.

According to the present invention, specifically, the angle formed between the rotational axis 26 of the chuck table 18 and the rotational axis 116 of the polishing pad 110 may be adjustable to make a line segment interconnecting a point on the outer circumferential edge of the holding surface 18*a* of the chuck table 18, whose distance to the polishing surface of the polishing pad 110 in a direction perpendicular thereto is the shortest, and the center of the holding surface 18*a*, parallel to the polishing surface.

The structural and method details according to the above embodiment and modification can be changed and modified without departing from the scope of the invention.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A processing method of polishing a workpiece having a circular surface to be polished using a polishing pad having a circular polishing surface, the processing method comprising:

a holding step of holding the workpiece on a chuck table having a conical holding surface having a protruding center;

an adjusting step of adjusting an angle formed between a rotational axis of the chuck table and a rotational axis of the polishing pad in order to make a line segment interconnecting a point on an outer circumferential edge of the holding surface, whose distance to the polishing surface in a direction perpendicular thereto is the shortest, and a center of the holding surface, parallel to the polishing surface;

a positioning step of moving the polishing pad and the chuck table horizontally relatively to each other to position the polishing pad above the chuck table such that first coordinates at which a point on an outer circumferential edge of the surface to be polished in alignment with the line segment is positioned do not overlap the polishing pad and second coordinates at which a center of the surface to be polished is positioned overlap the polishing pad in a coordinate plane parallel to the polishing surface; and a polishing step of polishing the workpiece by keeping the point on the outer circumferential edge of the surface to be polished at the first coordinates out of contact with the polishing surface and keeping a point on the outer circumferential edge of the surface to be polished at third coordinates on the coordinate plane that are different from the first coordinates in contact with an outer circumferential edge of the polishing surface while the polishing pad and the chuck table are being rotated about respective rotational axes thereof.

2. The processing method according to claim 1, further comprising:

a dressing step of dressing the polishing pad before the positioning step, wherein in the dressing step, a recess is formed in a circular central region of the polishing surface, and a portion of a boundary of an interface where the polishing surface and the surface to be polished are held in contact with each other in the polishing step is of an arcuate shape along an outer circumferential edge of the recess.

* * * * *